United States Patent [19]

Abinett et al.

[11] Patent Number: 4,738,596

[45] Date of Patent: Apr. 19, 1988

[54] FUEL PUMPING APPARATUS

[75] Inventors: Raymond E. Abinett, Rochester; Ghamdur S. Grewal, Gillingham, both of England

[73] Assignee: Lucas Industries Public Limited Company, Birmingham, United Kingdom

[21] Appl. No.: 79,669

[22] Filed: Jul. 30, 1987

[30] Foreign Application Priority Data

Aug. 16, 1986 [GB] United Kingdom ..... 8619991

[51] Int. Cl.[4] ..... F04B 21/02; F04B 25/00; F04C 15/02

[52] U.S. Cl. ..... 417/252; 418/267; 123/511

[58] Field of Search ..... 418/267, 268, 269; 417/251, 252; 123/510, 511

[56] References Cited

U.S. PATENT DOCUMENTS

| | | | |
|---|---|---|---|
| 2,708,884 | 5/1955 | Deschamps | 418/267 |
| 3,181,468 | 5/1965 | Roosa | 417/251 |
| 4,543,049 | 9/1985 | Shibuya | 418/269 |
| 4,610,614 | 9/1986 | Haga et al. | 418/269 |

*Primary Examiner*—Leonard E. Smith
*Assistant Examiner*—Leonard P. Walnoha
*Attorney, Agent, or Firm*—Balogh, Osann, Kramer, Dvorak, Genova & Traub

[57] ABSTRACT

A fuel pumping apparatus for supplying fuel to a compression ignition engine includes a high pressure pump to which fuel is supplied from the outlet of a low pressure pump of the vane type. The vanes of the pump are mounted in slots in the pump rotor and are spring biased outwardly. A cavity defined by the inner ends of the slots is connected by a spring loaded valve to the outlet when the output pressure is above a predetermined value and to a space in the housing of the apparatus through a valve when the output pressure is below said value. The space contains fuel which accumulates during the operation of the apparatus.

7 Claims, 1 Drawing Sheet

FIG 1
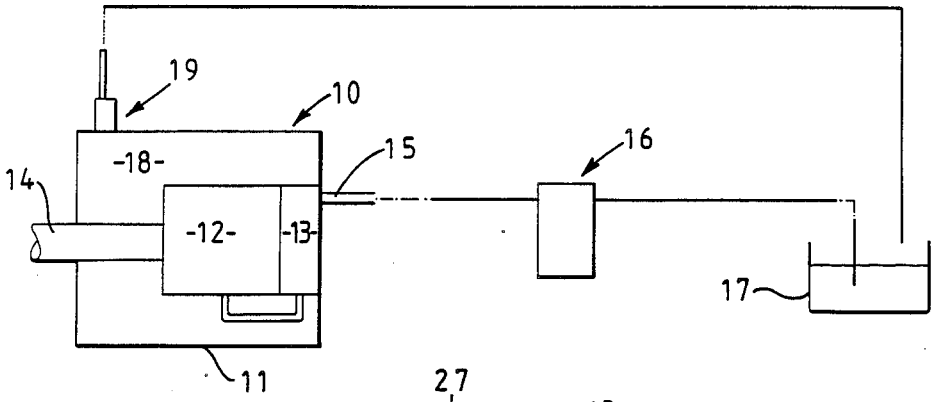
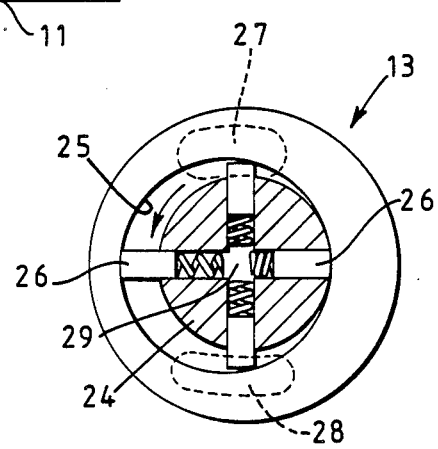
FIG 2
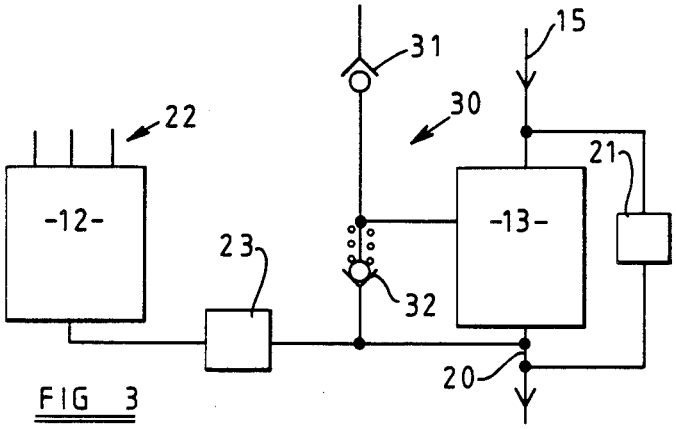
FIG 3

FUEL PUMPING APPARATUS

This invention relates to a fuel injection pumping apparatus for supplying fuel to an internal combustion engine and of the kind comprising a housing in which is mounted a high pressure pump and a low pressure pump having an outlet and which supplies fuel under pressure to the high pressure pump, the housing defining a space in which is located a component or components of the high pressure pump and in which space fuel can accumulate, the apparatus including a relief valve for controlling the pressure in said space and the low pressure pump being of the rotary vane type.

In a known form of such an apparatus the low pressure pump has four vanes with the diametrically opposed vanes being joined together. The tips of the vanes co-operate with a generally eccentrically disposed surface to achieve the pumping action and the production of the aforesaid surface requires great care to ensure that the minimum clearance exists between the tips of the vanes and the surface as the rotor, in which the vanes are mounted, rotates. The advantage of such a pump is that the vanes are positively moved in the slots in which they are mounted. The disadvantages namely the machining of the surface and the blades had led to the adoption of the more usual form of vane pump in which each vane is individually mounted in its slot with some form of resilient means to bias the vane outwardly into contact with the surface.

The output pressure of the low pressure pump is controlled by a relief valve so that the pressure varies with the speed at which the apparatus is driven. It is convenient to use the pressure to assist in biasing the vanes outwardly into contact with the surface since in this manner the biasing force rises as the pressure increases and there is no need to provide a resilient means for biasing the vanes of sufficient strength to cope with the maximum pressure. It has been found however that the low resilient forces are not really adequate to allow efficient repriming of the apparatus in the event that the fuel tank from which the low pressure draws its fuel, has been allowed to run dry. The object of the present invention is provide an apparatus of the kind specified in a simple and convenient form.

According to the invention in an apparatus of the kind specified said low pressure pump includes a rotor defining slots mounting the vanes respectively, resilient means biasing the vanes outwardly into engagement with an eccentrically disposed surface of a pump chamber, and valve means operable to connect said space to a cavity formed at the inner ends of said slots until the output pressure of the low pressure pump attains a predetermined value whereupon said valve means operates to apply the output pressure of the low pressure pump to the inner ends of said vanes.

An example of an apparatus in accordance with the invention will now be described with reference to the accompanying drawings in which:

FIG. 1 is a diagrammatic representation of a fuel system incorporating the apparatus, FIG. 2 shows the detailed construction of a low pressure pump forming part of the apparatus, FIG. 3 is a fluid circuit diagram of the apparatus, Referring to FIGS. 1 and 3 of the drawings, the fuel system includes a fuel injection pumping apparatus 10 which includes a housing 11 in which is mounted a high pressure pump 12 and a low pressure pump 13. The two pumps are driven by a drive shaft 14 which is connected to a rotary part of the associated engine so as to be driven in timed relationship therewith. The apparatus has a fuel inlet 15 which is connected by way of a fuel filter 16 to a fuel supply tank 17. Within the housing 11 of the apparatus there is defined a space 18 which contains moving parts of the high pressure pump which must be lubricated and fuel is allowed to accumulate in the space 18, the pressure of fuel in the space being controlled by a relief valve 19 through which fuel can be returned to the fuel supply tank 17. As shown in FIG. 3, the inlet 15 to the low pressure pump 13 and the outlet 20 are interconnected by a pressure relief valve 21 the action of which is to control the output pressure of the low pressure pump in accordance with the speed at which the apparatus is driven. The high pressure pump 12 has outlets 22 for connection in known manner to the injection nozzles of the associated engine and the flow of fuel to the high pressure pump from the outlet 20 of the low pressure pump is controlled by a throttling device 23.

The low pressure pump as shown in FIG. 2 is of the vane type and has a rotor 24 which is located in a pump chamber the interior surface 25 of which is eccentrically disposed relative to the axis of rotation of the rotor. The rotor carries vanes 26 which are slidable in slots in the rotor and which are lightly loaded outwardly by the action of springs. Communicating with the chamber is an inlet port 27 which is connected to the fuel inlet 15 and an outlet port 28 which is connected to the pump outlet 20. The pump operates in known manner.

In order to enhance the pumping action the cavity 29 defined by the slots and the inner ends of the vanes is connected to the outlet 20 of the pump so that the inner ends of the vanes are subject to the outlet pressure of the pump. This has the desirable effect of assisting the action of the springs to bias the vanes outwardly and since this pressure varies in accordance with the speed at which the apparatus is driven, the force applied to the vanes also varies with the speed and this materially assists in reducing the leakage between the surface 25 and the outer tips of the vanes.

With such an arrangement however it is found that if the fuel tank is allowed to run dry and then the tank replenished with fuel, a substantial time lapses before the apparatus is able to supply fuel to the associated engine. It has been found that this time can be substantially reduced if the cavity 29, defined at the inner ends of the vanes, is connected to the space 18 within the housing of the apparatus. For this purpose valve means generally indicated at 30 is provided the valve means in the example of FIG. 3, comprising a pair of non-return valves 31, 32 the valve 32 permitting the pressure from the outlet 20 of the pump to be supplied to the cavity 29 and the valve 31 connecting the space 18 to the cavity 29. In the situation therefore where fuel run out has occurred or where for example a filter element has been changed thereby introducing a substantial amount of air into the system, the cavity 29 is connected to the space 18 within the housing of the apparatus and the fuel which flows into the cavity is thought to provide a sealing action to enhance the pumping action of the pump until sufficient output pressure has been developed to cause the valve 32 to open and consequent closure of the valve 31.

The valve 32 is lightly spring loaded whereas the valve 31 comprises a free ball member which drops away from its seating to allow fuel flow to the cavity 29. The passage which accommodates the ball is disposed in use below the axis of rotation of the distributor member so as not to hinder the flow of fuel.

The valve 32 may be a differential valve whereby it opens at a higher pressure than the pressure at which it subsequently closes, the closing pressure being below that which obtains at the minimum engine speed. Furthermore, the valve may in addition control the application of fuel pressure to pressure responsive devices forming part of the apparatus such for example as a timing control piston.

We claim:

1. A fuel injection pumping apparatus for supplying fuel to an internal combustion engine, the apparatus comprising a housing, a high pressure pump mounted in the housing, a space defined in the housing and in which a component of the high pressure pump is located, said space in the use of the apparatus accumulating fuel, a low pressure pump of the rotary vane type for supplying fuel to the high pressure pump, a relief valve for controlling the pressure in said space, said low pressure pump including a rotor, slots defined in the rotor and vanes located in the slots respectively, resilient means biasing the vanes outwardly into engagement with an eccentrically disposed surface of a pump chamber, and valve means operable to connect said space to a cavity formed at the inner ends of said slots until the output pressure of the low pressure pump attains a predetermined value whereupon said valve means operates to apply the output pressure of the low pressure pump to the inner ends of said vanes.

2. An apparatus according to claim 1 in which said valve means comprises a first non-return valve which connects the outlet of the low pressure pump to said cavity and a second non-return valve which connects said cavity to said space.

3. An apparatus according to claim 2 in which said first non-return valve is a spring loaded valve which opens to connect the outlet with said cavity at said predetermined pressure.

4. An apparatus according to claim 2 in which said second non-return valve includes a free ball member and a seating, the ball member dropping away from the seating to connect the cavity and space.

5. An apparatus according to claim 3 which said first valve is constructed as a differential valve.

6. An apparatus according to claim 3 in which said second non-return valve includes a free ball member and a seating, the ball member dropping away from the seating to connect the cavity and space.

7. An apparatus according to claim 4 in which said first valve is constructed as a differential valve.

* * * * *